US005236024A

United States Patent [19]

Svensson et al.

[11] Patent Number: 5,236,024

[45] Date of Patent: Aug. 17, 1993

[54] COUNTER BLADE FOR A DISC CHIPPER

[75] Inventors: Ake Svensson, Själevad; Anders Olofsson, Örnsköldsvik, both of Sweden; Ari Hannimäki, Salpakangas; Pekka Kokko, Hollola, both of Finland

[73] Assignee: Kone Oy, Helsinki, Finland

[21] Appl. No.: 878,783

[22] Filed: May 5, 1992

[30] Foreign Application Priority Data

May 10, 1991 [FI] Finland ..... 912307

[51] Int. Cl.[5] ..... B02C 1/14

[52] U.S. Cl. ..... 144/176; 144/162 R; 144/373

[58] Field of Search ..... 241/242, 291; 144/162 R, 172, 174, 176, 373

[56] References Cited

U.S. PATENT DOCUMENTS

| | | | |
|---|---|---|---|
| 3,220,447 | 11/1965 | Marquez | 144/176 |
| 3,332,461 | 7/1967 | Ledergerber | 144/176 |
| 4,712,597 | 12/1987 | Stringer | 144/176 |
| 4,972,888 | 11/1990 | Dean | 144/172 |
| 5,139,063 | 8/1992 | Nettles et al. | 144/176 |

FOREIGN PATENT DOCUMENTS

G9103035.8 3/1991 Fed. Rep. of Germany .

*Primary Examiner*—W. Donald Bray

*Attorney, Agent, or Firm*—Lowe, Price, LeBlanc & Becker

[57] ABSTRACT

A counter blade is disclosed for use in a chipping machine which comprises a chipper disc rotatably mounted in the chipper frame by means of a shaft supporting the disc. The counter blade is attached to the chipper frame essentially at the intersection of a blade mounted in the chipper disc and the log to be chipped, in such manner that, on the side opposite to the chipping blade, the counter blade rests against the log to be chipped. The counter blade consists of a first and a second blade part placed at an obtuse angle relative to each other. According to the present invention, the counter blade consists of two essentially elongated elements having an arris forming the cutting edge of the counter blade at least on one of its longitudinal sides. The end faces of the counter blade elements are so formed as to permit connection to an adjacent counter blade element so that two counter blades form a continuous cutting edge of the counter blade.

8 Claims, 3 Drawing Sheets

COUNTER BLADE FOR A DISC CHIPPER

FIELD OF THE INVENTION

The present invention relates to a counter blade for a disc chipper designed for the chipping of wood.

BACKGROUND TO THE INVENTION

The production of wood chips for the paper and pulp industry is generally implemented using disc chippers, in which the wood is chipped by means of blades mounted in a radial, or nearly radial arrangement on a disc. As the disc rotates, the blades strike a log being chipped, the opposite side of which leans against a counter blade. The counter blade is located at the delivery end of a feed funnel, on the opposite side thereof relative to the direction of motion of the blade. The wood may be fed into the disc chipper either vertically or horizontally, and the chipper is accordingly called a horizontal-feed or a vertical-feed chipper. There are corresponding differences in the positions of the disc and blades in these different chipper types, but in principle they are essentially identical in operation.

In a disc chipper, the parts subject to wear are primarily the chipping blade and the counter blade, which receives the log being chipped. For the chips produced to be suitable for use as fibrous material, the counter blade must meet certain requirements regarding its condition. The cutting edge of the counter blade (i.e. the arris against which the log bears during chipping) must not have an excessive radius of curvature, otherwise the wood fibres will be broken and the result is low-quality chips containing sawdust.

In the known prior art, the counter blade consists of a relatively large and bulky body that requires a large amount of material and is difficult to handle during installation and maintenance. The wearing part of the counter blade is provided with a hard-metal coating which needs periodic renewal. At present, there are also counter blades of a lighter construction which are free of the above-mentioned drawbacks. However, there is still the problem that different parts of the cutting surface of the counter blade are unevenly worn due to the uneven distribution of logs. For this reason, the counter blade cannot be utilized in full.

To achieve an optimal chipping efficiency, the counter blade in a vertical-feed chipper consists of a horizontal part and another part placed in a direction slightly differing from the horizontal, so that the blade parts are at an angle slightly diverging from 180° relative to each other. In a blade construction like this, the horizontal blade area close to the junction of the parts is subject to the hardest wear, due to the manner in which the logs are directed in the feed funnel, and so the wear in this area determines the need for blade replacement. Therefore, when this small area of the whole effective surface of the blade has worn out, the whole blade must be replaced. If the counter blade has a hard-metal coating, renewing the coating means re-coating the whole blade.

SUMMARY OF THE INVENTION

An object of the invention is to produce a new counter blade construction which avoids many of the above-mentioned drawbacks of the prior art.

According to the present invention, there is provided a counter blade for a chipping machine which comprises a chipper disc rotatably mounted in a chipper frame, a plurality of chipper blades operatively mounted on said chipper disk, and a counter blade mounted in a counter blade holder of the chipper frame in close proximity to a plane of motion of said chipper blades, so that a log being chipped bears against said counter blade during chipping operation, said counter blade comprising a pair of elongate blade elements adapted to be operatively disposed in said chipper frame at an obtuse angle relative to each other, each said blade element including an arris disposed longitudinally along a side of said blade element, for forming a cutting edge of the counter blade; and end faces on each end of said blade element, said end faces being adapted to facilitate connection to an adjacent counter blade element so that the two counter blade elements cooperate to form a counter blade having a continuous cutting edge.

The invention allows the counter blade to be effectively utilized as only the worn part of the blade needs to be replaced. In respect of manufacturing techniques, the counter blade of the invention is advantageous since it does not involve any angular structures which are difficult to manufacture. By using blade parts of a symmetrical cross-section, it is possible to provide each blade part with two or more cutting surfaces. Also, it is possible to swap the two counter blade elements to replace the more worn part with a less worn one.

BRIEF DESCRIPTION OF THE DRAWINGS

Embodiments of the invention will now be described by way of example, with reference to the accompanying drawings, in which.

DETAILED DESCRIPTION OF A PREFERRED EMBODIMENT

Figure 1:
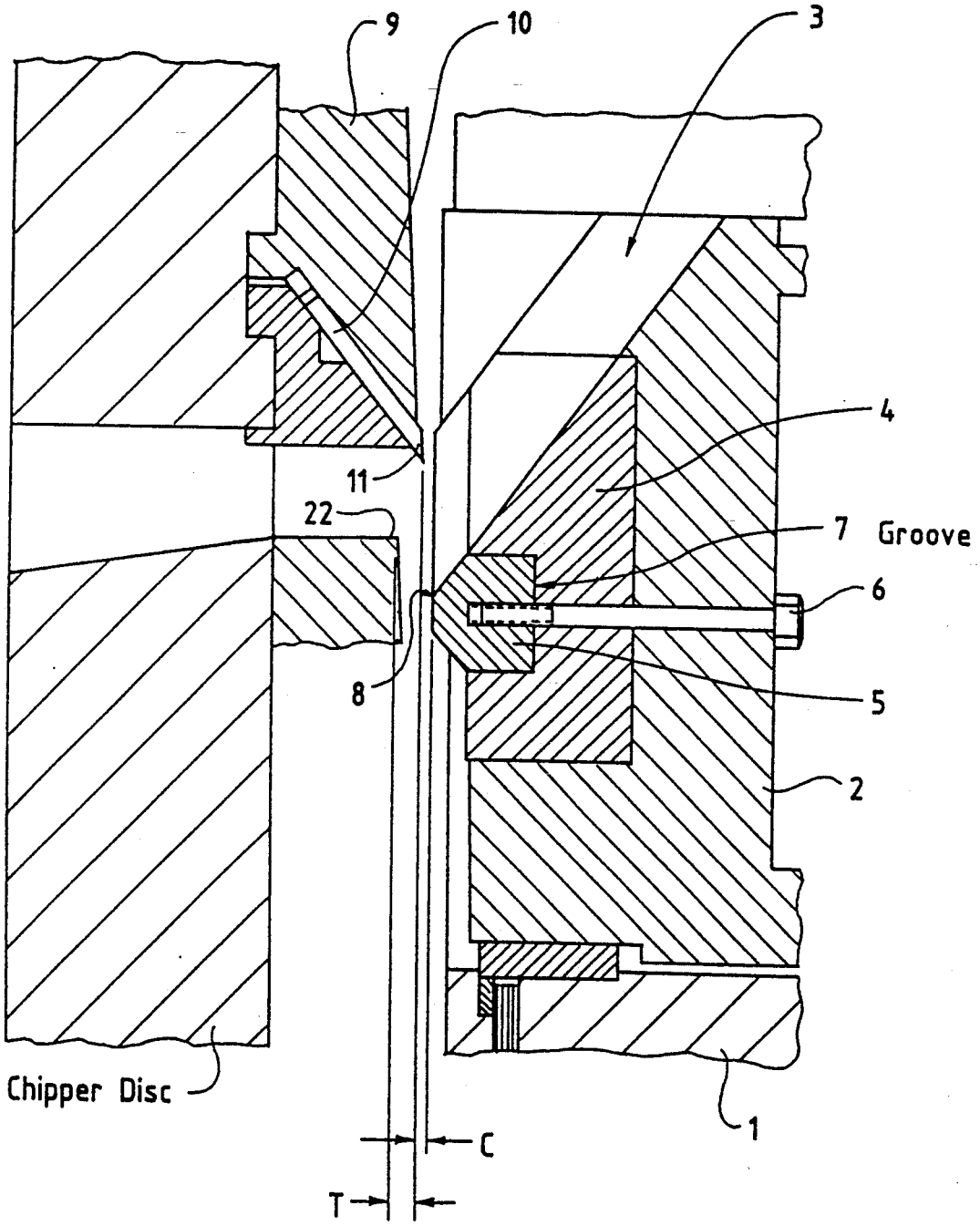
FIG. 1 shows a cross-section through a vertical-feed chipper, the position of a counter blade according to the invention.

As illustrated by FIG. 1, a vertical-feed chipper consists of a chipper frame 1 accommodating a counter blade carrier 2 which is movable relative to the frame 1. At the upper part of the counter blade carrier 2 there is a feed space which, together with a hollow space communicating with a log conveyor (not shown), forms a gravity funnel 3. Attached (e.g. by means of bolts, not shown) to the counter blade carrier 2 is a counter blade holder 4, which is placed at the delivery end of the gravity funnel 3. A counter blade element 5 is attached, by means of bolts 6, to a groove 7 provided in the counter blade holder 4. The surfaces of the counter blade holder 4 and the counter blade element 5 facing the gravity funnel 3 form a continuous and essentially even surface which allow logs to slide thereover. The cutting edge of the counter blade consists of an arris 8 located at the delivery end of the gravity funnel 3.

At the delivery end of the gravity funnel 3, there is a space housing a vertically mounted chipper disc 9 which is rotatable on a shaft (not shown). The shaft and the power means rotating the disc, which are suitably mounted on the chipper frame, are not shown and they can be implemented in a manner known in the art. The chipper disc 9 accommodated several, usually 12–16 blade bodies 10 provided with cutting blades 11 and mounted on the disc in a known manner.

The logs are brought to the funnel by means of conveyors and directed into the chipper in a known manner. The blades 11 of the disc 9 cut the wood into chips of a desired size. The chip length can be determined by adjusting the distance T between the blades 11 and stoppers 22 provided in the disc. This is done by moving the blade body 10 so as to obtain a suitable distance T, preferably approximately 13 mm. To achieve a good chipping efficiency, the distance C between the blade 11 and the counter blade 5 must be correct, suitably approximately 0.5 mm. Adjustment of the distance C can be accomplished by adjusting the position of the counter blade carrier 2 with respect to the chipper frame 1. The arris 8 forming the cutting edge of the counter blade must not be allowed to be rounded too much by wear. The radius of curvature must remain below 5 mm to ensure that the wood fibres are not damaged and that the chips produced will not contain sawdust.

Figure 2:
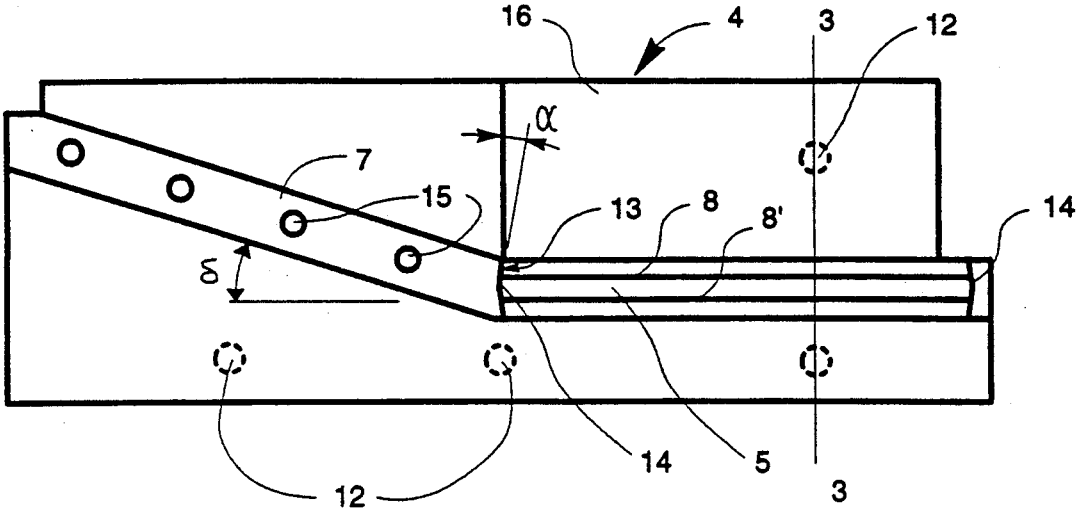
FIG. 2 illustrates the counter blade construction according to an embodiment of the invention.

FIG. 2 depicts the counter blade holder 4, and one of two counter blade elements 5 accommodated by it as seen from the side facing the disc 9. The holder 4 is provided with a groove 7 for the counter blade elements 5. The groove extends over the whole length of the holder and is bent into an angle $\delta$ at a point roughly midway between the ends. The thickness of that part of the holder which lies above the groove decreases towards the edge so that its surface 16 constitutes part of the wall of the funnel 3. The counter blade holder 4 is fixed to the counter blade carrier 2 by means of bolts screwed into holes 12.

Figure 3:
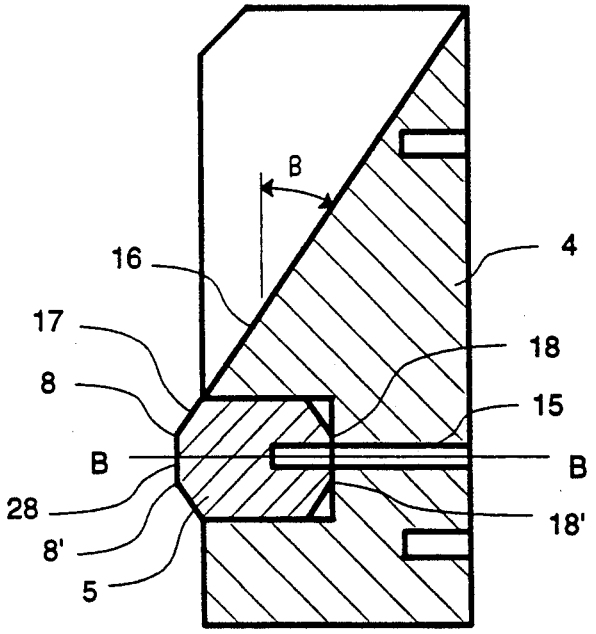
FIG. 3 shows a cross-section through the counter blade of FIG. 2 as sectioned along line 3—3.
Figure 4:
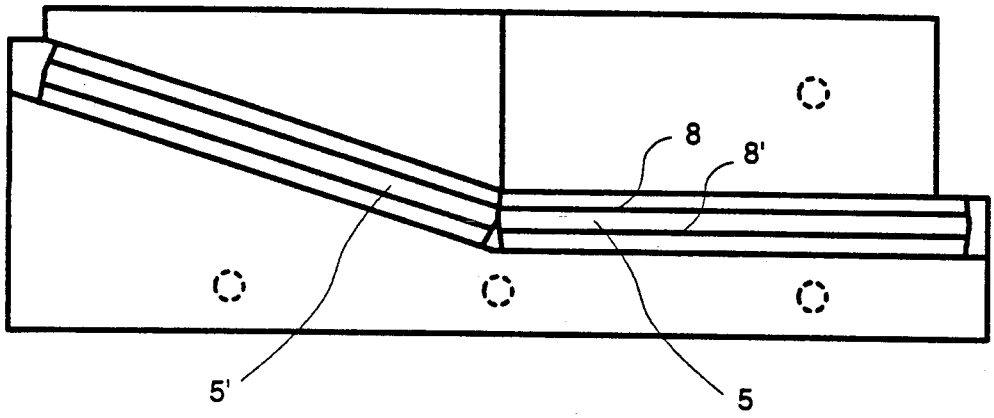
FIG. 4 illustrates the counter blade construction according to an embodiment of the invention.

The counter blade consists of two identical counter blade elements 5 and 5'. Each counter blade element 5 and 5' has two longitudinal arrises 8 and 8' placed at a distance from each other and forming the cutting edges of the counter blade. The counter blade element has a cross-section which is symmetrical about plane B—B, which is illustrated in FIG. 3. As shown in FIG. 4, when the two counter blade elements are placed in the groove 7 in the holder 4, the cutting surface of the counter blade has an elbow equal to angle $\delta$. The end faces 14 of the counter blade elements 5 form an angle $\alpha$ diverging from the straight angle relative to the longitudinal side of the part 5 Angle $\alpha$ is determined by the angle of the elbow at point 13. Thus, the parts can be so fitted together that a continuous blade arris 8 is formed at the upper edge of the counter blade.

In a preferred embodiment of the invention, as illustrated by FIG. 3, each counter blade element 5 is provided with four parallel arrises 8, 8', 18, 18', each of which is so made that it can act as the cutting edge of the counter blade. When the element 5 is in position, two of the arrises always face towards the chipper disc 9. One of these two arrises acts as the cutting edge. The other two arrises are essentially on the opposite side of the counter blade element 5 as seen in the direction of the shaft of the disc 9. It will thus be seen that, in this case, the counter blade element is symmetrical about two orthogonal planes of symmetry. Thus, each of the four arrises of each counter blade element 5 can be used as a counter blade cutting edge by suitably rotating the counter blade element 5.

In a preferred embodiment, the lower part of the end face 14 of the counter blade elements forms an angle of $180-2\alpha$ relative to the upper part of the end face. This renders the horizontal and oblique blade parts interchangeable. This is advantageous because the horizontal part of the counter blade is subject to faster wear than the oblique part, which is due to the fact that the logs under chipping tend to move horizontally side by side in the feed funnel 3. The minimum requirement is that the cutting edges of the two blade elements 5 should be in contact with each other. It is possible to place supporting or filling elements between the lower parts of the counter blade elements to achieve a continuous overall structure. It is also possible to provide the counter blade elements with end faces constituting parallel planes relative to each other. In this case, a given counter blade element can only be used in one position as the end faces of the other part of the counter blade slant in another direction.

The counter blade elements 5 are attached to the counter blade holder 4 by means of bolts 6 or equivalent placed in holes 15. The bolts can extend through the counter blade carrier 2 as shown in FIG. 1. The holes are symmetrically laid out so as to allow the elements 5 to be mounted in alternative positions and locations using the same holes and fixing elements. The elements 5 can be joined by their ends to each other or to the above-mentioned supporting structures e.g. by means of mortise-and-tenon joints.

FIG. 3 represents a cross-section of the counter blade holder 4 and counter blade element 5 as taken along line 3—3 in FIG. 2. Part 16 of the holder 4 is at an angle $\beta$ relative to the vertical plane. The counter blade element 5 is in the groove 7 and has a part 17 shaped in the same angle with the holder and protruding out of it. The front surface 28 of the counter blade element 5 is in a vertical position, so that arris 8 constitutes the cutting edge of the counter blade.

In the above, the invention has been described with reference to one of its embodiments. However, the invention is not restricted to this embodiment, but the scope of patent protection may vary within the limits permitted by the following claims.

We claim:

1. A counter blade for a chipping machine which comprises a chipper disc rotatably mounted in a chipper frame, a plurality of chipper blades operatively mounted on said chipper disk, and a counter blade mounted in a counter blade holder of the chipper frame in close proximity to a plane of motion of said chipper blades, so that a log being chipped bears against said blade during chipping operation, said counter blade comprising a pair of elongate blade elements adapted to be operatively disposed in said chipper frame at an obtuse angle relative to each other, each said blade element including:

an arris disposed longitudinally along a side of said blade element, said arris forming a cutting edge of the counter blade; and end faces on each end of said blade element, said end faces being adapted to facilitate connection to an adjacent counter blade element, whereby the two counter blade elements cooperate to form a counter blade having a continuous cutting edge formed of respective arrises of said adjacent counter blade elements.

2. A counter blade as claimed in claim 1, wherein said counter blade elements have two parallel, mutually spaced arrises capable of forming a cutting edge of the counter blade, whereby one of the arrises is selected to form a cutting edge of the counter blade by adjusting an orientation of said counter blade element in said counter blade holder.

3. A counter blade as claimed in claim 1, wherein said counter blade elements have four parallel, mutually spaced arrises capable of forming a cutting edge of the counter blade, whereby one of the arrises is selected to form a cutting edge of the counter blade by adjusting an orientation of said counter blade element in said counter blade holder, and whereby at least two arrises of each said counter blade element are substantially surrounded by said counter blade holder when the counter blade element is mounted in said counter blade holder.

4. A counter blade as claimed in claim 2, wherein each said counter blade element has at least one longitudinal plane of symmetry.

5. A counter blade as claimed in claim 3, wherein each said counter blade element has at least one longitudinal plane of symmetry.

6. A counter blade as claimed in claim 1, wherein the end faces of each counter blade element are so shaped that said counter blade elements are interchangeable in said counter blade holder.

7. A counter blade as claimed in claim 6, wherein said counter blade elements are mounted in the chipper frame such that the end faces of the counter blade elements are operatively separated by a portion of the counter blade holder.

8. A counter blade as claimed in claim 1, wherein the counter blade elements are rigidly attached to the counter blade holder, said counter blade holder being rigidly attached to a counter blade carrier which is adjustably mounted on said chipper frame.

* * * * *